United States Patent [19]

Bailey

[11] Patent Number: 4,756,104

[45] Date of Patent: Jul. 12, 1988

[54] MESSAGE DEVICE FOR USE WITH CLOTHES HANGERS

[76] Inventor: John W. Bailey, 5401 Burning Tree, Bakersfield, Calif. 93309

[21] Appl. No.: 934,547

[22] Filed: Nov. 24, 1986

[51] Int. Cl.[4] ..... G09F 3/00

[52] U.S. Cl. ..... 40/322; 223/85

[58] Field of Search ..... 40/17, 18, 19, 322, 40/484, 377, 111; 242/55.2; 223/85, 87, 88, 92, 98; 206/281, 284

[56] References Cited

U.S. PATENT DOCUMENTS

| | | | |
|---|---|---|---|
| 1,318,041 | 10/1919 | Anthony | 40/19 |
| 2,903,807 | 9/1959 | Brunengraber | 40/114 |
| 2,931,657 | 4/1960 | Lewis | 40/114 |
| 3,024,953 | 3/1962 | O'Keefe | 40/322 |
| 3,898,754 | 8/1975 | Johansson | 40/322 |
| 3,949,914 | 4/1976 | Ostroll | 40/322 |
| 4,045,899 | 9/1977 | Richardson | 40/322 |
| 4,115,940 | 9/1978 | Phillips | 40/322 |
| 4,198,773 | 4/1980 | Batts et al. | 40/322 |
| 4,416,425 | 11/1983 | Kish | 242/55.2 |
| 4,679,340 | 7/1987 | Johansson | 40/322 |

FOREIGN PATENT DOCUMENTS

| | | | |
|---|---|---|---|
| 2064472 | 6/1981 | United Kingdom | 223/85 |

*Primary Examiner*—Gene Mancene
*Assistant Examiner*—Michael Lynch
*Attorney, Agent, or Firm*—I. Michael Bak-Boychuk

[57] ABSTRACT

A cylindrical message display including a plurality of stacked relatively rotatable cylindrical segments each inscribed with messages at discrete radial increments of the peripheral surfaces thereof received in a frame which clips onto the hook portion of a clothes hanger. By aligning a selection of messages against an index the state of wear of the clothing on the hanger can be displayed.

3 Claims, 1 Drawing Sheet

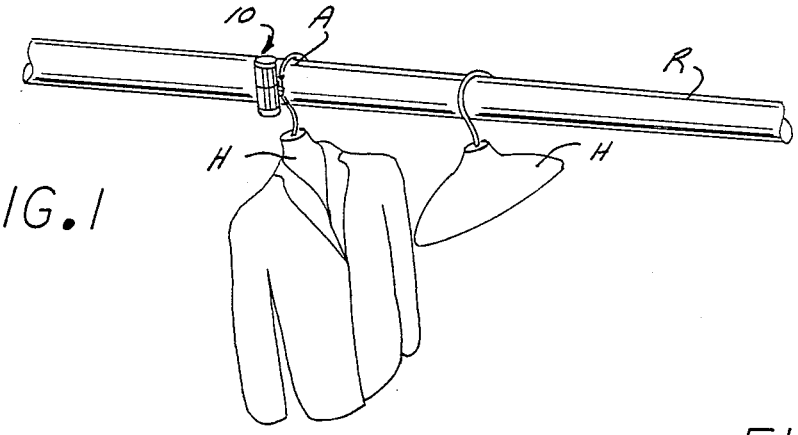
FIG. 1
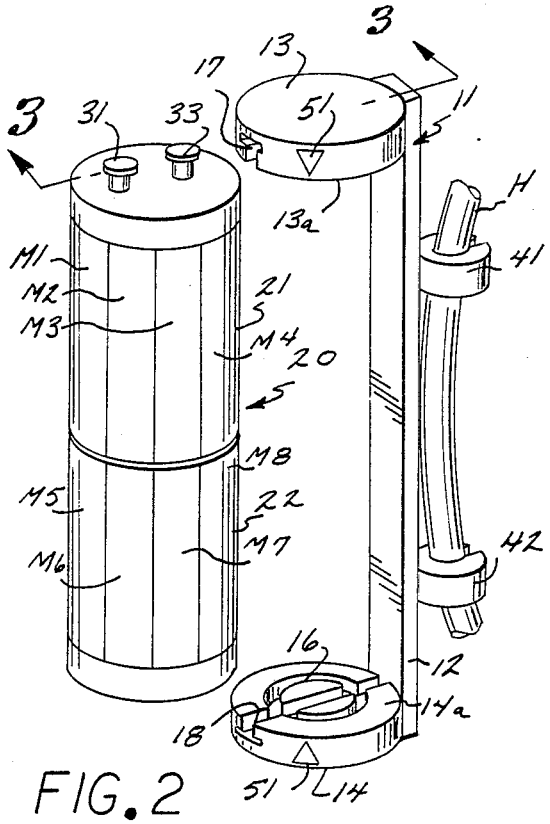
FIG. 2
FIG. 3
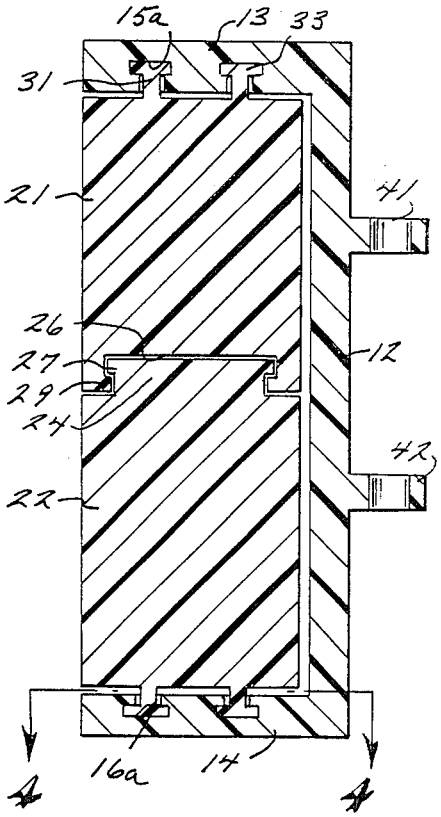
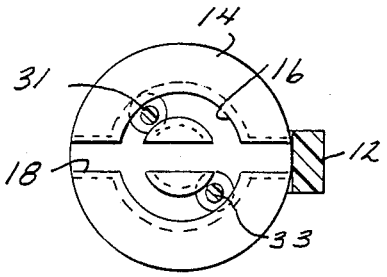
FIG. 4

MESSAGE DEVICE FOR USE WITH CLOTHES HANGERS

BACKGROUND OF THE INVENTION

1. FIELD OF THE INVENTION

The present invention relates to clothing display devices, and more particularly to selective display mechanisms useful with clothes hangers.

2. DESCRIPTION OF THE PRIOR ART

Display and marking devices of clothing racks and clothes hangers have been known in the past. Most frequently such display devices are used in a commercial setting, as size or price displays of various clothing items on the rack. In this use the display tags are frequently in the form of markers. Commercial needs, however, lack the impetus for hanger devices in which the message is changed at will, as for example, in U.S. Pat. No. 4,198,773 which sets out a slotted marker conformed for side insertion onto a hanger hook. Similarly, U.S. Pat. No. 4,045,899 teaches a cylindrical stack, once again mounted by slots onto the hanger. Both the foregoing examples, while suitable for their purposes, attend only to the requirements of commercial use. Hence improvements are desired for configuring markers useful in the home. It is one such improvement that is disclosed herein.

SUMMARY OF THE INVENTION

Accordingly, it is the general purpose and object of the present invention to provide a marker assembly useful to indicate the state of wear of personal clothing.

Other objects of the invention are to provide a marker assembly which is both convenient in attachment and in message selection.

Yet further objects of the invention are to provide a clothing marker by which the user of the clothing can keep track of the number of times the clothing article is worn.

Briefly, these and other objects are accomplished within the present invention by providing a C-shaped bracket defined by a lateral spine as a longitudinal edge extending between two opposed offset discs. The spine includes spaced clips extending therefrom conformed to engage the hook of a hanger, each disc including in the opposed surface thereof a circular recess communicating with the exterior edge. A cylindrical insert comprising two or more coaxial, relatively rotatable, barrel segments, is provided with opposed disc recesses and which then select the angular presentation to each cylinder segment. The cylinder segments can then be inscribed with messages around their periphery, which when aligned against an index will present, for example, the number of times the articles have been worn.

The foregoing assembly may be conveniently fabricated of any resilient material structure, such as any of the semi-rigid polymer groups and is thus convenient in fabrication and use.

BRIEF DESCRIPTION OF THE DRAWINGS

FIG. 1 is a perspective illustration of a personal clothes hanger arrangement provided with the inventive device;

FIG. 2 is yet another perspective illustration, separated by parts of the inventive device shown in FIG. 1;

FIG. 3 is a sectional side view taken along line 3—3 of FIG. 2; and

FIG. 4 is yet another sectional view, in detail, illustrating the cooperative aspects of the barrel segments useful with invention herein.

DESCRIPTION OF THE PREFERRED EMBODIMENT

As is shown in FIG. 1, a typical clothing closet found at today's residences includes a horizontal hanger rod R onto which hangers H ar hung, in side-by-side alignment. Each hanger H including a hook assembly A in suspended engagement on the rod R. In conventional practice alignment of rod R is laterally across the closet and hangers are therefore removed and inserted from the exposed side. Consequently, each hook assembly A will be aligned with the opening thereof away from the user, providing a common segment onto which display messages can be affixed.

In accordance with the present invention such message devices are shown generally at 10, each comprising a C-shaped bracket 11, defined by a vertical spine 12 connected to two opposed discs 13 and 14 at the ends thereof. Hence discs 13 and 14 extend as cantilevered elements from the ends of spine 12 to present opposed surfaces 13(*a*) and 14(*a*) towards each other. Each one of these surfaces 13(*a*) and 14(*a*) includes a circular recess 15 and 16 formed in the manner of a groove with an enlarged bottom section 15(*a*) and 16(*a*). A similarily shaped set of grooves 17 and 18 are then formed across each circular recess to extend to the exterior periphery of each disk 13 and 14 and thus to form a communicating path through the circular recesses. The spacing between the opposed faces of discs 13 and 14, in turn, is selected to the longitudinal dimension of a stacked barrel assembly 20 comprising an upper cylinder 21 and a lower cylinder 22. Cylinders 21 and 22 are axially engaged to each other by way of a central projection 24 on the adjacent end of cylinder 22 which includes a peripheral groove 26 into which a lip 27 extending from a peripheral skirt 29 at the bottom of barrel 21 is received. At the distal ends the barrel assembly 20 is provided with an upper set of space posts 31 and 33 and a lower set of space posts 32 and 34 which respectively are sized for insertion into the circular grooves 15 and 16 of the C-shaped bracket 11.

One should note that the foregoing arrangement allows for selective withdrawal and/or insertion of the barrel assembly into the bracket and furthermore permits the rotation of the upper barrel 21 relative the lower barrel 22. Each of the barrels can then be inscribed with various messages M1–M8 in angular and vertical alignment, the upper barrel for example having messages relating to the upper garment hung on the hanger H while the lower barrel carrying messages of the state of the lower garment. The spine 12, distal of discs 13 and 14, includes two spaced circular, slotted, clips 41 and 42 conformed for engagement ont the hook assembly A. Moreover, the periphery of discs 13 and 14 may be inscribed with an index marker 51 which then allows for the message indexing of each barrel in the course of use. Thus the inventive assembly is conveniently engaged to the hook of the hanger and once thus engaged provides a convenient technique for displaying the necessary messages to the user. Since the user in each occasion of use will necessarily manipulate the hanger, there is an attendant convenience to the inventive device which can then be concurrently manipulated.

The operative aspects of the inventive assebmbly having thus been described one needs little further description of the cooperative function thereof. Of course, larger number of stacked barrels can be used, depending on the message content and no intent to limit the scope of this invention to the above choices is thus expressed.

Obviously, many modifications and changes may be made to the foregoing without departing from the spirit of the invention. It is therefore intended that the scope of the invention be determined solely on the claims appended hereto.

What is claimed is:

1. Apparatus for selective display of message combinations securable to a clothes hanger, comprising:

a frame member including an elongate spine piece provided with engagement means for selective attachment onto said hanger, said spine piece terminating in a first and second circular mount extending in cantelever from the ends thereof in opposing presentation;

said first and second circular mount including arcuate grooves in the opposed faces thereof;

a cylindrical assembly positioned between said first and second circular mount, said cylindrical assembly including a plurality of axial cylindrical segments engaged in a peripherally clasped engagement rotatable relative each other, each said segment having inscribed on the exterior thereof a plurality of messages in radial alignment; and said cylindrical assembly including posts on the distal ends thereof, said posts being positioned in said grooves.

2. Apparatus according to claim 1 wherein:

said engagement means comprises a plurality of spaced arcuate clips conformed to grasp the hook portion of said hanger.

3. Apparatus according to claim 2 wherein:

said frame member and cylindrical assembly are formed of a polymer structure; and said first and second circular mounts include index projections at the peripheral edges thereof.

* * * * *